United States Patent [19]

Harjar

[11] 4,194,696

[45] Mar. 25, 1980

[54] ELECTROSTATIC SPRAY COATING GUN

[75] Inventor: Martin J. Harjar, Vermilion, Ohio

[73] Assignee: Nordson Corporation, Amherst, Ohio

[21] Appl. No.: 848,042

[22] Filed: Nov. 3, 1977

Related U.S. Application Data

[62] Division of Ser. No. 705,338, Jul. 14, 1976, Pat. No. 4,079,894.

[51] Int. Cl.[2] ..... B05B 5/00

[52] U.S. Cl. ..... 239/707

[58] Field of Search ..... 239/15, 707; 118/629

[56] References Cited

U.S. PATENT DOCUMENTS

| | | | |
|---|---|---|---|
| 3,476,319 | 11/1969 | Thatcher | 239/15 |
| 3,589,607 | 6/1971 | Wolf | 239/15 |
| 3,837,573 | 9/1974 | Wagner | 239/15 |

*Primary Examiner*—John J. Love

*Attorney, Agent, or Firm*—George J. Coghill

[57] ABSTRACT

An electrostatic spray coating gun has an improved high voltage charging system which includes a flexible and resilient electrode in the form of an elongated coil spring. This form of electrode substantially eliminates the likelihood of scratching or puncturing the skin of an operator or repairman, and allows the electrode to return to its proper orientation after being bumped, while exhibiting good paint charging characteristics for use in electrostatic spray coating.

5 Claims, 3 Drawing Figures

ELECTROSTATIC SPRAY COATING GUN

This is a division of application Ser. No. 705,338, filed July 14, 1976 now U.S. Pat. No. 4,079,894.

FIELD OF THE INVENTION

This invention relates to electrostatic spray coating guns, and more particularly relates to electrostatic spray coating guns for coating materials which have a high or moderately high electrical conductivity.

Spray coating, both electrostatic and non-electrostatic are established arts. In non-electrostatic spray coating systems paint is atomized and directed toward some article to be coated. In electrostatic spray coating systems a high voltage electrical charge is applied to the paint particles either before, during or after to the atomization process. The high voltage electrical charge applied to the paint improves the efficiency and coating characteristics of a spray coating system used to coat objects which are held at or near ground potential. There are other applications for and general advantages of electrostatic spray coating systems, however, they need not be discussed here, being well known in the art.

Electrostatic spray coating systems generally employ an atomizing device or gun, a pump or other means to supply paint to the gun, a source of high voltage electrical power, and means connected to the high voltage power and associated with the system to charge the paint. The subject of the present invention deals with the spray coating gun, including the means employed to charge the paint.

In general, electrostatic coating guns consist of a barrel portion having a paint conduit. One end of the paint conduit is connected to a source of coating material under pressure, and the other end terminates in a spray discharge device or nozzle. The nozzle, in the usual spray coating situation, produces a flat-fan shaped cloud of paint droplets. Many of the nozzles in the past could be rotated so that the fan pattern could be oriented horizontally, vertically or at some intermediate position.

A valve is usually employed to control the discharge of paint. It has been the general practice in various types of spray coating guns to have the valving located in the conduit in the barrel very close to the discharge orifice of the nozzle. Separating surface valves with mating surfaces such as needle and seat or ball and seat type valves have been common. A pull rod extending into the conduit has been used to open and close the valve. Some type of seal between the opening into the conduit and the pull rod itself prevented the gun from leaking through the opening. The seals in the past have in various guns taken the form of both packing type seals and packingless type seals. Packing type seals are dynamic seals. That is, the pull rod slides inside the packing material which is urged against the periphery of the opening into the conduit and is also urged against an outward surface of the pull rod. These packing type seals are adequate for some systems but had drawbacks in others, especially electrostatic systems. Packing seals of their very nature did not provide an electrical seal. Specifically, in a system using paint having high to moderate electrical conductivity, an electrical path could be established along the surface of the pull rod to the exterior of the conduit, since the paint would wet the surface of the rod. This electrical leakage path is undesirable in electrostatic spray coating systems since it could present a path which would short the high voltage electrical power to ground, or present a safety problem of sparking or shock to the operator. Further, the sliding caused the packing material to wear, especially when the coating material in the conduit was abrasive.

To overcome the disadvantages of the packed seal, various electrostatic spray coating guns have employed packingless seals. These packingless seals generally took the form of a deformable diaphragm, such as a bellows, surrounding the rod. In a bellows type, one end of the bellows has a static seal to the periphery of the opening into the conduit, and the other end of the bellows has a static seal around the pull rod. The seals are termed "static" because there is no sliding of the rod over the seal. When the pull rod moves the bellows flexes while the seals remain fixed with respect to the sealing surfaces.

The prior art bellows/static seal arrangements solved some of the problems associated with sliding seals, the most important being the friction wear and electrical insulation. However, new problems arose in the prior art bellows seals. It has become desirable to fabricate the bellows from a fluorinated hydrocarbon polytetrafluoroethylene and commonly known by the tradename TFE "Teflon", because of the superior electrical and chemical properites of TFE Teflon. Electrically, TFE Teflon is a good insulation and does not arc-track. Chemically, TFE Teflon is impermeable to almost all coating material; that is the coating materials will not chemically attack the TFE Teflon, nor will these coating materials permeate the structure of the TFE Teflon. The prior art teflon bellows had heavy walled mechanical coupling type ends. For an example, see U.S. Pat. No. 3,747,850. The ends of such bellows, as well as the bellows itself, had been machined parts. The heavy walled machined ends of these prior art bellows were generally sealed to the rod and to the opening by means of mechanical couplings similar to those used for some types of pipes. The heavy walls did not readily deform greatly when urged against another surface. Therefore, either the sealing surfaces required close machining tolerances, or a gasket. Close machine tolerances are expensive, and gaskets such as O-rings do not exhibit the desirable characteristics of Teflon. Therefore, the seals were either expensive, or alternatively, if a gasket were used there was a weakness in the seal at the gasket.

Another important aspect of electrostatic type spray coating guns is the means used to charge the paint. Various means have been employed in the past. Some have charged the paint with a stiff needle-like electrode in close proximity to the discharge of the spray nozzle, with the electrical path to the electrode from the high voltage supply desirably through the barrel. Having the electrical path in the barrel is desirable to minimize the size of the gun, and because the barrels of many prior art guns were made from insulating materials which serve to insulate the electrical components from contact by the operator. If the gun had a nozzle which rotated, the position of the electrode in many prior art guns was also made rotatable about the barrel. The rotation of the electrode was accomplished by means of an electrical slip ring in the barrel, wherein the electrode would contact the slip ring at different locations as the electrode was rotated.

Positioning the electrode close to the discharge orifice in a nozzle worked well when spray coating materials having high electrical resistivities i.e. above 200,000

Ohms/cm. However, when such an arrangement was used for coating materials having high or moderately high electrical conductivities, the paint column in the barrel could "short out" the high voltage supply if the paint supply was grounded. Therefore, many prior art guns had electrodes which were carried forward of the nozzle and outside of the flat-fan spray pattern where the gun was used for such paints. By moving the electrode forward of the nozzle the paint could be adequately charged at a point where the paint had already separated into isolated droplets. Therefore, the paint supply could be grounded without shorting out the high voltage power supply because there was sufficient stand-off or isolation due to physical distance between the paint column and the electrode though the air. The electrode was placed outside of the fan pattern of the spray nozzle so that the electrode did not get painted. If the electrode were painted, its paint charging characteristics could be diminished, perhaps to the point of inoperability.

Similarly to the guns designed for paint of low conductivity, attempts have been made to make the electrode in the guns for conductive (high and moderate) paints continuously rotatable around the spray nozzle so that the electrode could be at the same relative position with respect to the spray pattern if the nozzle were rotated. The most notable of these attempts is described in U.S. Pat. No. 3,937,401. In this patent a slip ring around the barrel close to the discharge orifice of the nozzle maintains the electrical path to the electrode when the extension for the electrode is rotated. This slip ring arrangement does allow for rotation of the electrode extension, however, it exhibits many drawbacks as do all slip ring arrangements. Providing electrical insulation and stand-off of the slip ring and contacting components is complicated and has generally required either bulky housings or electrically insulating grease, or both.

In another aspect of electrostatic spray coating guns, the charging electrode itself is an important consideration. In the past, the electrode has taken the form of a stiff needle-like conductor with one end connected through an insulating housing or through the barrel to the high voltage supply, and with the other end protruding from the insulating housing or barrel at a point proximate the spray pattern. Such electrodes were dangerous to operators or repairmen because the electrode could scratch or puncture the skin. Further, if the electrode were bumped or caught and pulled, the electrode could be bent out of its preferred orientation. In the event of such bending, the coating efficiency of the system could be diminished as a result of reduced charging of the paint.

In addition to the shortcomings of the prior art listed above, there has never been a commerically acceptable method or apparatus for applying glaze in slurry form to a substrate electrostatically. The prior art devices were susceptible to rapid wear of internal parts, and required the whole coating material supply system to be electrically charged to a high voltage. Therefore, the entire coating material supply system was required to be physically and electrically isolated from ground potential, and from personnel. Hence, the prior art devices resulted in a process and system which was cumbersome, time consuming, and only marginally safe.

SUMMARY OF THE INVENTION

The subject of the present invention is a spray gun which overcomes the shortcomings of the prior art listed above. Various novel aspects of this gun can be utilized in electrostatic or non-electrostatic spray coating guns. Still further, various novel aspects of this gun combine to provide compatibility with a greater range of coating materials and applications than have heretofor been possible.

One aspect of this invention is an improved bellows type seal between an opening into the coating material conduit in the barrel of the spray gun and a pull rod which extends into the conduit through the opening to control a valve in the conduit. It is desirable to have the bellows made out of Teflon, and specifically, tetrafluoroethylene, because of the superior electrical and chemical properties of the material (as described above). By a new process (which is not part of the subject of this invention) an inexpensive bellows can be formed from a thin walled tubular piece of Teflon without machining. The end product is a bellows where each end of the bellows has a thin walled continuous tubular extension of the same material which forms the convolutes of the bellows. The diameter of the thin walled extensions of the convolutes of the bellows in the preferred embodiment approximate the diameter of the smaller portion of the convolutes. Because of the low cost, it is desirable to use this type of bellows. However, when attempting to form the seals at the ends of such a bellows it was found that the Teflon would "flow" out of many types of sealing arrangements where two surfaces are urged together tight enough to form a hydraulic seal. Therefore, new types of seals for the ends were required. It is one object of this invention to provide seals for this type of bellows construction between one end of the bellows and the opening, and between the other end and the pull rod. After devising the seals it was found that these same seals were compatible with other materials besides Teflon.

It is a further desirable aspect of a bellows type seal that all surfaces exposed to the material in the conduit be impermeable to that material. Therefore, it is a further object of this invention to provide static seals at the ends of the bellows mentioned above, where all materials exposed to the bellows and seals are impermeable to the material in the conduit.

It is a further object of this aspect of the invention to provide seals and bellows which are easily constructed, diassembled, and repairable.

It is a further object of this invention to provide a bellows type sealing arrangement constructed of materials which have superior electrical chemical and sealing qualities.

One specific aspect of this invention is the seal between the thin walled extension of the bellows mentioned above to the pull rod in the conduit. The extension of the bellows is trapped between urged tapered locking surfaces of the rod and a bushing-like member. In a preferred form the tapered locking surface on the rod constitutes part of a bulge on the rod which is larger than the inside diameter of the thin walled extension of the bellows. Further, in the preferred embodiment, the thin walled extension of the bellows is pushed over and at least partially encompasses the largest part of the bulge, the bulge not being large enough to permanently deform the thin walled extension of the bellows.

Another specific aspect of this invention is the seal between one end of the bellows and the opening into the conduit. This seal comprises a Teflon jacketed elastomeric washer around one tubular extension of the bellows and urged against the periphery of the opening into the conduit. A solid washer also around the same extension of the bellows has one side urged against this Teflon jacketed washer. The end of this extension of the bellows is flared so that the outward surface of the bellows can be urged against the other side of the solid washer. An elastomeric washer around the rod is urged against the inward surface of the bellows at the flare by suitable means urging the whole assembly together.

Another aspect of this spray gun is a novel means of mounting an extension for a high voltage electrode so that it can be angularly displaced about the barrel of the gun by turning rather than by removal and repositioning. Angular turning displacement is made possible without the use of slip rings, while maintaining proper electrical standoff of all electrical components with respect to the exterior of the gun and the material coating conduit in the gun, and without any need for sealing grease, and without excessive bulk of the barrel of the gun. An elongated insulated conductor, which is flexible, but resistant to compression and tension, extends into an electrical passage in the barrel of the gun, and also extends into an electrical passage in the extension member. The end of the conductor in the extension member makes pivotable electrical contact with a compressed spring which in turn is electrically connected to a charging electrode at the end of the extension. The other end of the conductor makes a pivotable electrical contact to a compressed spring in the rear part of the barrel. This spring in turn is connected to a high voltage cable. All of the electrical components are properly insulated in positions to provide adequate electrical isolation from the exterior of the gun and from the paint conduit in the barrel. Space is left around the barrel so that the conductor can partially "wrap" around the barrel when the electrode extension is angularly displaced. The extension is made of Teflon to preclude the possibility of arc tracking and the resultant reduction in the electrical resistance of its surface.

In a preferred form the charging electrode is made from a length of coiled spring. Therefore, the electrode will return to its proper orientation for electrostatic spray coating even after being bumped. Further, the danger of skin puncture or scratching is enormously reduced. Still further, these benefits are achieved while maintaining proper high voltage charging of the paint.

It is a further aspect of this gun to provide electrostatic spray coating capabilities with glazes in slurry form, as well as other types of electrically conductive to moderately conductive coating materials. A slurry of glaze material almost invariably comprises a suspension of glaze material in water. The reasons for using water are varied, and are not necessary to discuss here. For a good discussion of glazes in general, reference can be made to a text entitled "Ceramic Glazes" by C. W. Parmelee (1973). The water used to make the slurry has the effect of making a slurry electrically conductive, which in itself presents the same problems associated with any conductive coating material. A further problem results from the fact that particles suspended in the water are extremely abrasive. The abrasive particles can be raw silicates, or can be fritted (e.g. ground glass). In the present gun the displaced positioning of the charging electrode, bellows/static seal arrangement for the pull rod, large flow passages, and abrasion resistant materials at the valve and the discharge orifice of the nozzle, make this gun compatible with glazes in slurry form. The gun of the present invention has been used successfully to apply both the fritted and the raw silicate types of glaze slurries. It has been used to electrostatically apply glaze enamel slurries used for clayware, and porcelain enamel slurries used for metal.

It is a further aspect of this gun to provide a nozzle: which is compatible with highly abrasive materials such as porcelain enamel in slurry form; which minimizes costs and manufacturing problems; which is compatible with spray guns that are adapted to be used with spray nozzles established as standard in the industry; and which is reliable, inexpensive and durable.

DETAILED DESCRIPTION OF THE PREFERRED EMBODIMENT

Figure 1:
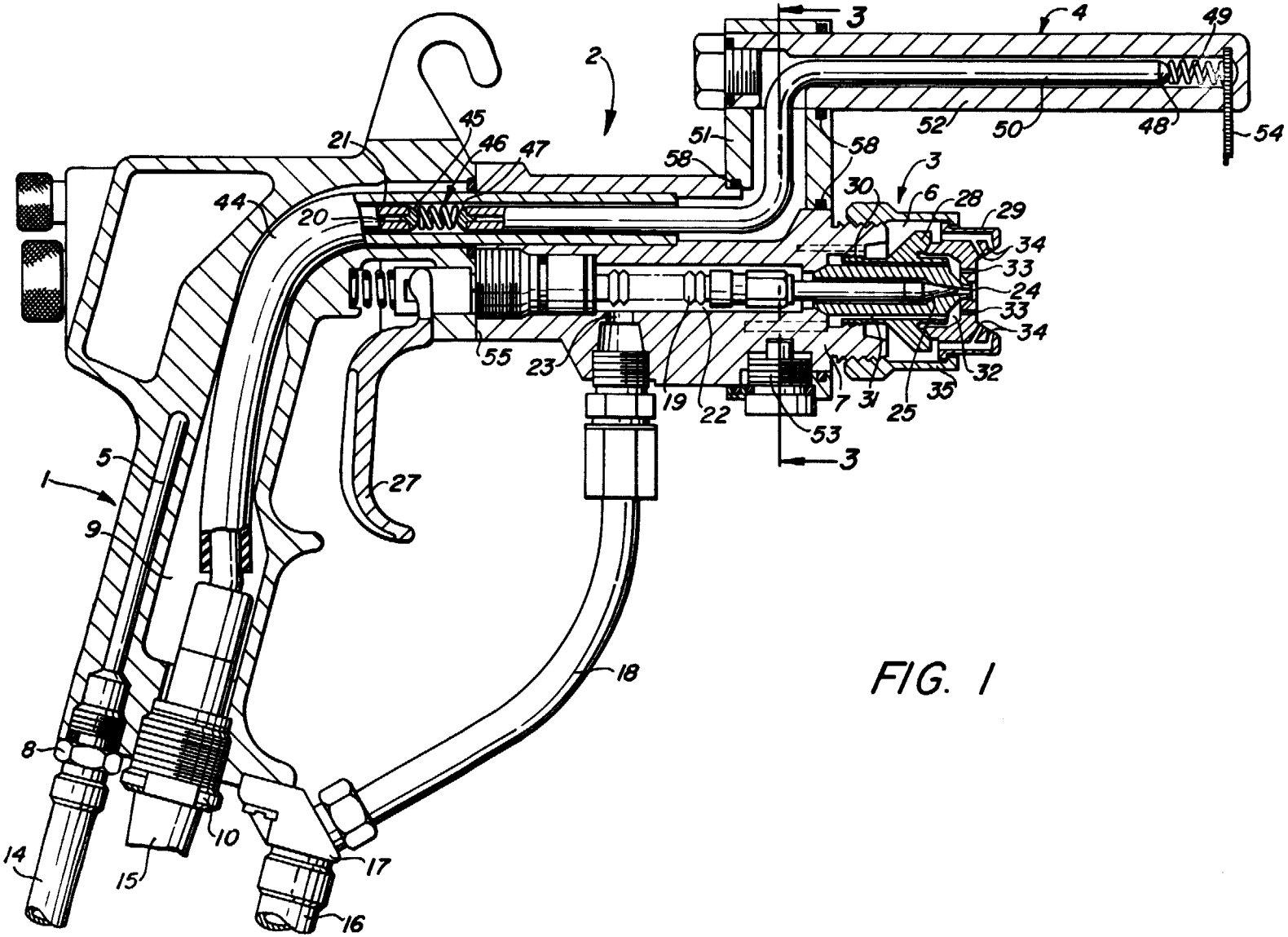
FIG. 1 is a cross-sectional view of an air atomizing electrostatic spray gun embodying a preferred form of this invention.

FIG. 1 shows a cross-sectional view of an electrostatic spray gun. The spray gun generally consists of a metallic handle 1, a barrel 2 made of insulating material such as Delrin, a nozzle 3, and an electrode extension 4. One end of the barrel 2 is mounted to the handle 1, while the nozzle 3 is located at the other end of the barrel 2. The electrode extension 4 is mounted for annular displacement about the barrel 2.

The handle 1 is made of metal and is held at electrically ground potential through a suitable electrical connection (not shown). An air line 14 is connected to an air passage 5 in the handle 1 through a suitable connector 8. The air passage 5 extends through the handle 1 and barrel 2 and eventually communicates with a first air chamber 6 and a second air chamber 7 both in the barrel 2 close to the nozzle 3. The air passage 5 extends for part of its length through the handle 1 and barrel 2 in a plane different than that through which the cross section of FIG. 1 is taken, and therefore, phantom lines in the barrel 2 close to the nozzle 3 indicate the openings of the air passage 5 to these first and second air chambers 6 and 7.

Also connected to the butt end of the handle 1 is an insulated electrical cable assembly 15. The cable assembly 15 is secured to the butt end of the handle 1 by a suitable retaining nut 10. An extension 20 of the cable assembly 15 is carried into an electrical conduit 9 in the handle 1. The core of the cable assembly 15 can be any suitable electrical conductor such as stranded wire or a cable core having distributed resistance in it such as described in U.S. Pat. No. 3,348,186 issued to Rosen. A polyethylene sheath 21 surrounds the cable extension 20 to provide electrical insulation except for an electrical contact 45 at the end of the extension 20. The other end of cable 15 is connected to a high voltage power supply (not shown). The specific novel details of the electrical path through the spray gun will be described in further detail below.

Still describing the gun generally and now referring to the paint supply path of the gun, a paint supply hose 16 carries paint under pressure to a paint supply hose connection block 17. The connection block 17 is metallic and is attached physically and electrically to the butt end of the handle 1 of the gun. A passage (not shown) through the block 17 communicates with one end of a nylon paint supply link 18. The other end of the paint supply link 18 communicates with a paint inlet opening 23 in the barrel 2 of the gun. The link 18 is attached between the block 17 and the barrel 2 of the gun by suitable pressure fluid connections.

The paint inlet opening 23 communicates with a paint conduit 22 in the barrel 2. The paint conduit 22 progresses to a discharge orifice 24 of the nozzle 3. Needle and seat valving is provided immediately upstream of the discharge orifice 24. The needle 25 of the needle and seat valve assembly is attached to a pull rod 26 made of an acetal homopolymer commonly known by the DuPont trade name "Delrin" (shown in FIG. 2). The pull rod 26 extends into the paint conduit 22 through an opening at the rear of the paint conduit 22. The paint conduit 22 is sealed closed around the pull rod 26 by means of a TFE Teflon bellows 19 having a static seal to the rod at one end, and a static seal to the periphery of the opening at the other end. The details of this sealing arrangement will be described below.

The pull rod 26 is connected to a spring loaded trigger 27. When the trigger 27 is displaced in a rearward direction, the needle 25 is retracted from the seat behind the discharge orifice 24, and allows paint to be discharged.

When spraying abrasive coating materials, the needle and seat valve assembly is preferably made of an abrasion resistant material such as ceramic or carbide.

Referring now to the nozzle 3 portion of the gun, generally it can be seen by those skilled in the art that it is similar to prior art air atomizing nozzles in many respects. The nozzle 3 consists of a fluid nozzle portion 28 with a ceramic liner 30, air cap 29 and a retaining nut 35. All of these parts other than the liner 30 are made of Delrin. This nozzle assembly is similar to nozzles old in the art, save for the ceramic liner 30 in the fluid nozzle 28.

The fluid nozzle 28 has threads on the outward surface of its rearward end for threadable attachment to the forward end of the fluid passage 22 in the barrel 2. The fluid nozzle 28 is threaded into the barrel 3 until a rearward frusto-conical outer surface on the liner 30 engages a mating surface surrounding the flow passage 22. These two surfaces form a hydraulic seal so that the fluid passage 22 extends only through the interior of the liner 30 to the discharge orifice 24. The inside surface of the liner, immediately behind the discharge orifice of 24 of the fluid nozzle 28, forms the seat in the needle and seat valve.

An air cap 29 partially surrounds the forward end of the fluid nozzle 28. The discharge orifice portion 24 of the fluid nozzle 28 extends through a centrally disposed hole in the air cap 29. A retaining nut 35 threadably engages the barrel 3 and urges a rearward frusto-conical surface of the air cap 29 against a mating surface on the fluid nozzle 28 through the interaction of a circumferential annular inward flange at the forward end of the retaining nut 35 with circumferential outward flange on the air cap 29.

The first air chamber 6 in the nozzle portion is formed between the surfaces of the barrel 3, retaining nut 35, air cap 29 and fluid nozzle 28. Air passages in the air cap communicate with the first air chamber 6 and terminate in air discharge openings 34.

Several air passages 31 are formed in the fluid nozzle 28. These air passages are distributed uniformly around the axis of the fluid flow passages and function to communicate pressurized air from the second sealed air chamber 7 in the nozzle portion to a third air chamber 32 close to the discharge orifice 24 of the fluid nozzle 28. Holes 33 in the air cap discharge air from the third air chamber 32. In operation, as is known in the art, the interaction of air being discharged from the air holes 33, 34, in the air cap 29, interact to atomize and shape the stream of fluid being discharged from the nozzle orifice 24.

The sealing surfaces of the air cap 29 are radially symetrical, and, therefore, the air cap 29 is rotable about the axis of the fluid discharge nozzle 24. That is, the air cap can be rotated so that the flat fan spray of the nozzle can be oriented in the plane of the paper, perpendicular to the plane of the paper of any angle in between.

Referring again to the fluid path in general, it is noted here that the fluid conduit 22 is made large enough for most of its extent to maintain fluid velocities at a relatively low value. The only places where the fluid velocity in the fluid conduit 22 is at any relatively high value is around the needle and seat valve and at the fluid discharge orifice 24. However, because the needle and seat and the orifice 24 are formed in the unitary abrasion resistant liner 30 the spraying of highly abrasive materials will not rapidly deteriorate the surfaces and components.

There are alternative approaches to construction a wear resistant fluid nozzle. The approach taken here is a Delrin body with a wear resistant liner 30. The fluid nozzle 28 could have been made totally out of wear resistant material, however, it has been found that the liner approach offers distinct advantages. It is desirable to use ceramic materials for the wear resistant surfaces in the fluid nozzle. However, ceramic is brittle. The Delrin body provides an added layer of mechanical shock insulation for the ceramic material. If the whole fluid nozzle were made of ceramic the chance of fracture would be increased.

Even if a stronger material such as carbide were used for the wear resistant surfaces, problems would arise. It is desirable to make the fluid nozzle in the shape depicted in FIG. 1, so that the gun is compatible with other fluid nozzles and air caps which are considered as standard in the industry. The desirability of using "standard" fluid nozzles and air caps is based upon the need for a versatile spray gun which can use several different types of fluid nozzles and air caps. It is noteworthy that this fluid nozzle is topologically a rather complex structure containing mating surfaces and small air passages. If the fluid nozzle were a single piece of abrasion resistant material, the fabrication process for the fluid nozzle would be further complicated; namely, the very formation of the surfaces and maintenance of engineering tolerances would be difficult. With the "liner" approach used in the preferred embodiment, the fabrication process is simplified.

Figure 2:
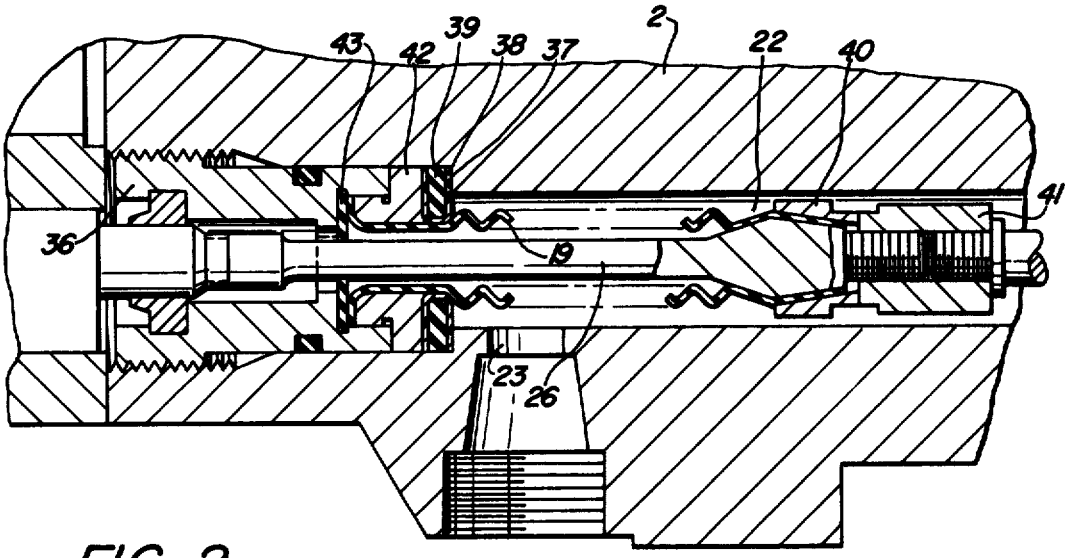
FIG. 2 is an exploded cross-sectional view of the bellows sealing arrangement for the valve pull rod extending into the coating material conduit in the barrel portion of the spray gun of FIG. 1.

Turning now to specific details, and referring to FIG. 2, the details of the bellows sealing arrangement between the opening into the fluid conduit 22 and the pull rod 26 which extends into the fluid conduit 22 can be observed. As can be seen in FIG. 2, the pull rod 26 extends into the fluid conduit 22 from the rear of the spray gun. A generally cylindrical or tubular TFE-teflon bellows 19 surrounds the rod 26. The convoluted section of the bellows 19 is thin walled and has thin walled cylindrical extensions at each end. At the rearward end of the bellows 19, the cylindrical extension has been flared. At the forward end of the bellows, the cylindrical extension has been pushed over and encompasses a bulge on a pull rod 26. The bulge on the pull rod 26 is large enough to slightly expand the thin walled extension of the bellows 19 but is not large enough to permanently deform it. The cylindrical extension must be at least moderately resilient so that upon pushing the forward end of the bellows 19 beyond the largest part of the bulge the resiliency of the extension causes it to attempt to return to its original size and, thereby, snugly conform to the shape of the bulge. The forward portion of the bulge is a conical locking tapered surface. A bushing type member 40 has an internal locking tapered surface which mates to that on the bulge of the rod 26. A nut 41 is threadably attached to the pull rod 26 and is screwed down to such an extent that the bushing type member 40 locks the end of the tubular extension of the bellows 19 to the pull rod 26.

At the rearward end of the bellows 19 is a second cylindrical extension of the convolutes with a flared rearward end. A teflon jacket 38, surrounds the tubular extension of the bellows. The jacket 38 is made of teflon and is generally in the form of two thin walled deformable annular membranes which are spaced apart along a common axis but which are continuous through their smaller or inner annular diameter. The space between the membranes is filled with rubber or some other elastomeric material 39. One face of the jacket is urged against an annular face 37 of the barrel 2, which face 37 surrounds the opening into the fluid conduit 22. The jacket is urged against the annular face 37 around the fluid conduit 22 by means of a Delrin second washer means 42. The flare of the rearward extension of the bellows 19 is in urged engagement with the rearward surface of the second washer means 42. A rubber washer is urged against the inside surface of the bellows at the flare by a Delrin packing nut 36. The packing nut 36 forces the washer 43 against the flare which in turn is urged against the second washer means 42 which in turn is urged against the Teflon jacketed elastomeric washer 39 which in turn is urged against the annular face surrounding the opening into the fluid conduit 22.

In this arrangement for the static seals at each end of the bellows, fluid is only exposed to Delrin or teflon. These two substances exhibit excellent chemical resistance to almost all spray coating fluids. There are no rubber surfaces such as O-rings or packings which contact the fluid in the fluid conduit 22. Further, these static seals allow the use of a teflon bellows which does not require machining in its fabrication.

Referring now again to FIG. 1, the details of the electrical path in the spray gun will be described. As stated above, high voltage electrical power is supplied to the gun through an insulated high voltage cable core 20 in high voltage cable assembly 15. The cable core 20 extends beyond the connecting nut 10 and is surrounded for its entire length by a polyethylene sheath 21 which provides electrical insulation.

The handle 1 and barrel 2 of the gun are separable at a point 55 just forward of the trigger 27. An electrical conduit 9 extends through the handle 1 and into the barrel 2.

A polyethylene tube 44 extends from the point of separation 55 into both the electrical conduit 9 in the handle 1 and in the barrel 2 for a considerable distance in either direction. The electrical conduit 9 itself extends through the handle 1, through the barrel 2, then exits from the barrel into an extender support housing 51, and then finally, through a passage in an electrode extender 52. The cable extender support housing 51 is mounted for angular displacement and is sealed from the exterior of the electrical passage by O-rings 58. The details of the housing 51, its mounting and the details of the electrode extender 52 will be discussed below.

Continuing with the description of the electrical path itself, a contact 45 at the end of the cable core 20 butts against one end of a first electrically conductive spring 46. The second end of the first spring 46 butts against an electrical contact on a cable extender 50. The cable extender 50 is flexible and of similar construction to that of the cable core 20 and is sheathed by flexible polyethylene. The cable extender 50 has electrical contacts 47, 48 at each end of its length and extends in a continuous piece from electrical contact to the first electrically conducting spring 46 at its rearward end to electrical contact with a second electrically conducting spring 49 at its forward end. The second electrically conducting spring 49 is located at the forward end of the electrical conduit in the electrode extension 52. The spring 49 also contacts one end of an electrode 54. The electrode 54 is embeded in the extension 52 so that one end is exposed to the atmosphere and the other end is in electrical contact with the second spring 49.

The electrode 54 comprises a tightly coiled filament of electrically conductive spring steel, having the tip of the filament which forms the spring directed generally along the length of the spring at its exterior end. The tip pointed along the length of the spring forms a needle like Corona point which effects the electrostatic charging of the sprayed coating material.

The electrode 54 in the preferred embodiment has been made uniformly flexible along its length so that it will resiliently deform regardless where a deforming force is applied.

The extender support housing 51, which supports the electrode extender 52, is Delrin and is mounted on the barrel 2 of the gun such that a passage inside of the housing communicates with the electrical passage 9 in the barrel 2 of the gun. The electrode extender 52 is mounted in an opening on the housing 51. An opening in the side of electrode extender 52 provides communication between the passage in the housing 51 and a passage in the extender 52. O-rings 58 seal the housing 51 closed around the barrel 2 and around the extension 52. This sealing is to prevent contaminants from reaching any surfaces inside of the electrical passage 9. Contaminants on these surfaces could reduce the resistivity of the surfaces, and hence, give rise to a possible electrical path which could short out the high voltage system or present a danger of sparking.

Figure 3:
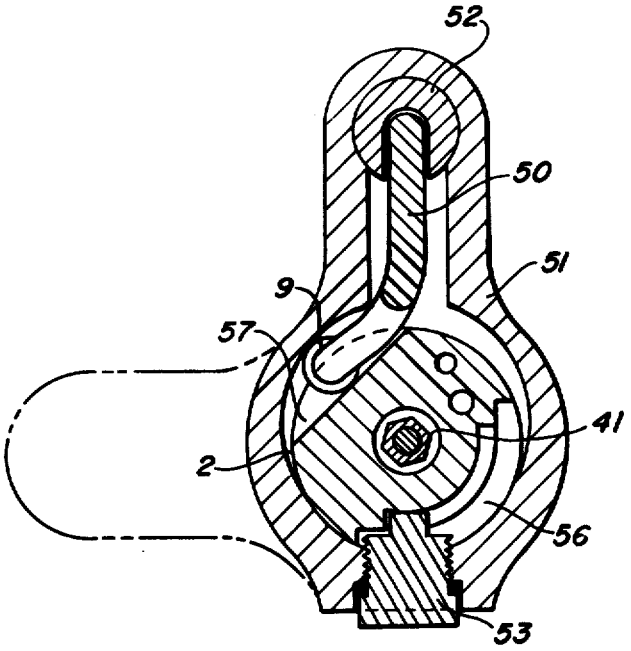
FIG. 3 is a cross-sectional view of the spray gun of FIG. 1 through the plane defined by the dotted line 3 in FIG. 1, which shows the effect of angular displacement of the electrode extension on the electrical path.

Details of the housing 51 and construction of the electrical passage 9 can be more fully appreciated by reference to FIG. 3, which is a cross-sectional view of the gun through the dotted line designated 3 in FIG. 1. As can be seen in FIG. 3, the housing 51 surrounds the barrel 2 of the gun. A nut 53 sealed by an O-ring extends into a recess 56 on the barrel 2. The nut 53 bears against the surface of the recess 56 in order to fix the angular displacement of the housing 51. The barrel 2 of the gun has a flat surface which forms a cavity or chamber 57 between the barrel 2 and the housing 51. This chamber 57 is to receive the cable extender 50 upon angular displacement of the housing 51. The chamber 57 for the cable extender 50 could be in other forms, or could extend further around the barrel 2 of the gun. It can be appreciated, however, from observing the possible positions of the housing under angular displacement (indicated by phantom lines) that 90° angular displacement will allow the electrode 54 to be properly positioned with respect to the fan when spraying in virtually any usable orientation. This is because, in virtually all commercial applications, the fan is either oriented horizontally or vertically.

Referring now to both FIGS. 1 and 3, it is noted here that upon angular displacement from a 45° orientation the cable extender 50 will have more of its length in the second chamber 57 around the barrel. However, the first and second springs 46, 47, will lengthen or extend themselves in order to maintain the electrical contact with the cable extender 50.

The springs 46, 47, tend to relieve any longitudinal stresses in the cable extender 50 when more or less of the cable extender 50 is wrapped around the barrel 2 in the second chamber 57. The contacts at the springs are pivotable. Therefore, the pivotal contacts also function to relieve torsional stresses in the electrical conductor 50 when the housing 51 is angularly displaced. Other pivotable contacts and lengthening means could be substituted, however, the contacts used in the preferred embodiment have been found acceptable.

Referring now to FIG. 1, the placement of the electrode 54 will be considered. The extension 52 carries the electrode 54 externally forward of the spray nozzle orifice 24. The electrode 54 is displaced from the axis of the nozzle opening 24. This displacement of the electrode 54 from the nozzle orifice 24 is necessitated by the fact that the gun is designed to operate with highly conductive materials. In electrostatic paint spray systems it is desirable to have the paint supply for highly conductive materials maintained at ground potential. If the electrode 54 would be positioned close to the nozzle discharge orifice 24, the electrical standoff through the air wound not be sufficient, since the fluid column of electrically conductive paint would effectively represent an electrical ground potential at the nozzle orifice 24. If the distance between the electrode 54 and the nozzle orifice 24 is not sufficiently great, then the voltage at the electrode 54 would be shorted out through the paint column or present the possibility of sparking to this point of ground. The length of the extension 52 is chosen so that it carries the electrode 54 forward of the nozzle by a distance sufficiently great to maintain a 20 kilovolt per inch standoff between the electrode and the closest point of ground and yet be close enough to the atomized particles of paint to effectively charge them to a high voltage. The electrode 54 is displaced from the axis of the spray so that it does not become covered with coating material under operation.

Now considering other electrical isolation or standoffs between any point in the system which is at high voltage to a point which is at ground potential, two different types of standoffs must be considered: the standoff through dielectrics and the standoff along an air path or along the surface of some component. The electrical standoff through a dielectric can be controlled by selecting a material whose dielectric constant and whose thickness maintains a sufficient standoff. However, the standoff along surfaces, or through the air, can only be maintained by displacement unless some type of an electrical seal can be effected around the components. Electrically insulating seals between components which remain fixed with respect to one another can be achieved. For example, a nonconductive cement can be used. However, the nonconductive cementing process is itself an expensive procedure. Further, when parts are to be movable with respect to one another, cementing is incompatible with movability. Prior art high voltage electrical sealing between movable parts in an electrostatic spray coating gun have used an insulating grease such as described in the above mentioned U.S. Pat. No. 3,937,401. However, this approach has been proven unacceptable for various reasons.

In the electrostatic spray coating gun, which is the subject of the present invention, it is to be noted that the high voltage standoff along air gaps or surfaces components is accomplished without the necessity of electrically insulating seals. The standoff is maintained by means of physical displacement only and yet the structure allows the mounting of the electrode extension on the barrel in such a way that the electrode can be angularly displaced around the axis of the spray pattern.

Because there is no discontinuity in the sheath around the cable extension 50 right at the point of angular displacement of the housing 51, there is no need for an electrically insulating seal at this point.

It will be noted further that the electrical contacts between cable 20 and the first spring 46 and between the first spring 46 and the cable extender 50 are removed from the point of angular displacement of the housing 51 to a point proximate the junction of the barrel 2 and the handle 1. Further, because the contacts to the first spring 46 are made inside of the polyethylene tube 44, and standoff along surfaces and air gaps (i.e., along the discontinuity at the junction of the barrel 2 and the handle 1 or to the handle itself) is maintained at a safe level. In actual practice, safe or adequate standoffs or isolation through air or along noncontaminated surfaces should be at least 0.04 inches per kilovolt of electrical power used; and along contaminated surfaces, at least 0.1 inches per kilovolt of electrical power used.

Having now described our invention, it can be seen that many modifications can be made to the gun as described without departing from the scope and spirit of the invention of which I claim:

1. An electrostatic spray coating gun comprising:

means to form and discharge a stream of coating material which breaks up into droplets;

means to apply an electrical charge to the coating material prior to deposition on a substrate, wherein the means to apply the charge to the coating material comprises an electrode located externally of the paint gun and which is resiliently flexible for substantially its whole length; and a short needle-like electrically conductive portion of the electrode at an exterior end thereof.

2. The apparatus of claim 1 wherein the resiliently flexible portion is a coiled spring.

3. The apparatus of claim 2 wherein the coiled spring is formed from a continuous filament of conductive material and a short part of the end of the filament that forms the spring comprises the needle like portion.

4. An electrostatic spray coating gun comprising:

means to form and discharge a stream of coating material which breaks up into droplets; and means to apply an electrical charge to the coating material prior to deposition on a substrate, wherein the means to apply the charge to the coating material comprises an electrode located externally of the paint gun which is resiliently flexible along a major portion of its length and wherein the resiliently flexible portion is a coiled spring.

5. The apparatus of claim 4 wherein the coiled spring is formed from a continuous filament of conductive material and a short part of the end of the filament that forms the spring is directed generally away from the spring.

* * * * *